US008311743B2

(12) United States Patent
Gurpinar

(10) Patent No.: US 8,311,743 B2
(45) Date of Patent: Nov. 13, 2012

(54) METHOD FOR GENERATING AN ESTIMATION OF INCREMENTAL RECOVERY FROM A SELECTED ENHANCED OIL RECOVERY (EOR) PROCESS

(75) Inventor: Omer M. Gurpinar, Denver, CO (US)

(73) Assignee: Schlumberger Technology Corporation, Sugar Land, TX (US)

( * ) Notice: Subject to any disclaimer, the term of this patent is extended or adjusted under 35 U.S.C. 154(b) by 428 days.

(21) Appl. No.: 12/491,401

(22) Filed: Jun. 25, 2009

(65) Prior Publication Data

US 2010/0004865 A1 Jan. 7, 2010

Related U.S. Application Data

(60) Provisional application No. 61/133,894, filed on Jul. 3, 2008.

(51) Int. Cl.
*G01V 9/00* (2006.01)
*G06F 19/00* (2006.01)

(52) U.S. Cl. ..... 702/6; 702/13; 703/10

(58) Field of Classification Search ..... 702/6, 11–13; 703/10; 705/7.28; 435/168; 166/252.4; 526/129

See application file for complete search history.

(56) References Cited

U.S. PATENT DOCUMENTS

| | | | | |
|---|---|---|---|---|
| 6,980,940 | B1 | 12/2005 | Gurpinar | |
| 7,478,024 | B2 | 1/2009 | Gurpinar | |
| 2003/0225606 | A1 | 12/2003 | Raghuraman | |
| 2005/0043891 | A1 | 2/2005 | Bush | |
| 2005/0149307 | A1 * | 7/2005 | Gurpinar et al. | 703/10 |
| 2007/0143025 | A1 | 6/2007 | Valdez | |
| 2007/0298479 | A1 | 12/2007 | Larter | |

FOREIGN PATENT DOCUMENTS

| | | | |
|---|---|---|---|
| DE | 129035 | C | 2/1902 |
| WO | WO2007018909 | A1 | 2/2007 |

OTHER PUBLICATIONS

C.J. Covell, F.E. King, J.W.W. Morgan: "The Chemistry of Extractives from Hardwoods. Part XXXI. 2-Acetyl-1dihydroxy-3-methylnaphthalene (Musizin), A Constituent of *Maesopsis eminii*." Journal of the Chemical Society, 1961, pates 702-706, XP002542866 p. 704, line 32-line 46; relevant to claims 1-3,5,6.

* cited by examiner

*Primary Examiner* — John H Le
(74) *Attorney, Agent, or Firm* — Colin Wier

(57) ABSTRACT

A method is disclosed for generating an estimation of an incremental recovery that can be expected from an Enhanced Oil Recovery (EOR) Process, comprising: selecting a set of reservoir properties; selecting an EOR process that is associated with the selected set of reservoir properties; and generating the estimation of the incremental recovery that can be expected from the selected EOR process.

8 Claims, 8 Drawing Sheets

METHOD FOR GENERATING AN ESTIMATION OF INCREMENTAL RECOVERY FROM A SELECTED ENHANCED OIL RECOVERY (EOR) PROCESS

CROSS REFERENCE TO RELATED APPLICATIONS

This application claims priority under 35 U.S.C. §119(e) from Provisional Patent Application No. 61/133,894 filed Jul. 3, 2008, entitled "Method for Generating an Estimation of Incremental Recovery from a Selected Enhanced Oil Recovery (EOR) Process", which is hereby incorporated by reference in its entirety.

BACKGROUND

The subject matter set forth in this specification relates to a 'method for generating an estimation of an incremental recovery that can be expected from a selected Enhanced Oil Recovery (EOR) Process' (including a corresponding system and program storage device and computer program) that is practiced by an 'Enhanced Oil Recovery (EOR) Selection and Design Tool software' stored in a memory of a computer system.

In view of increasing oil prices and declining reserves, the demand for increased recovery and production of oil from oilfield reservoirs has been growing. Enhanced Oil Recovery (EOR) processes for oilfield reservoirs are selected, and, responsive thereto, oil is recovered from the oilfield reservoir at a particular rate. However, the selection of a particular Enhanced Oil Recovery (EOR) process (hereinafter, either an 'EOR Process' or an 'EOR scheme'), associated with a particular level of recovery from the reservoir, is currently being accomplished in a time consuming and disintegrated way. There exists no specific tool that would allow a user to: select 'reservoir properties', select an applicable EOR scheme associated with the 'reservoir properties', and, responsive thereto, generate an 'estimation of the incremental recovery that can be expected from the applicable EOR scheme'. This specification discloses a method (including a corresponding system and program storage device and computer program) that will guide a user in order to locate and identify technically and economically applicable EOR schemes for oilfield reservoirs in an integrated and efficient manner in order to estimate an incremental recovery that can be expected from a selected Enhanced Oil Recovery (EOR) Process.

SUMMARY

An embodiment of the invention involves a method for generating an estimation of an incremental recovery that can be expected from an Enhanced Oil Recovery (EOR) Process, comprising: selecting a set of reservoir properties; selecting an EOR process that is associated with the selected set of reservoir properties; and generating the estimation of the incremental recovery that can be expected from the selected EOR process.

Another embodiment of the invention involves a program storage device readable by a machine, tangibly embodying a set of instructions executable by the machine, to perform method steps for generating an estimation of an incremental recovery that can be expected from an Enhanced Oil Recovery (EOR) Process, the method steps comprising: selecting a set of reservoir properties; selecting an EOR process that is associated with the selected set of reservoir properties; and generating the estimation of the incremental recovery that can be expected from the selected EOR process.

In another embodiment, the invention involves a computer program stored in a processor readable medium and adapted to be executed by the processor, the computer program, when executed by the processor, conducting a process for generating an estimation of an incremental recovery that can be expected from an Enhanced Oil Recovery (EOR) Process, the process comprising: selecting a set of reservoir properties; selecting an EOR process that is associated with the selected set of reservoir properties; and generating the estimation of the incremental recovery that can be expected from the selected EOR process.

Another embodiment of the invention involves a system adapted for generating an estimation of an incremental recovery that can be expected from an Enhanced Oil Recovery (EOR) Process, comprising: apparatus adapted for selecting a set of reservoir properties; apparatus adapted for selecting an EOR process that is associated with the selected set of reservoir properties; and apparatus adapted for generating the estimation of the incremental recovery that can be expected from the selected EOR process.

Further scope of applicability will become apparent from the detailed description presented hereinafter. It should be understood, however, that the detailed description and the specific examples set forth below are given by way of illustration only, since various changes and modifications within the spirit and scope of the 'method for generating an estimation of an incremental recovery that can be expected from a selected Enhanced Oil Recovery (EOR) Process', as described and claimed in this specification, will become obvious to one skilled in the art from a reading of the following detailed description.

BRIEF DESCRIPTION OF THE DRAWINGS

A full understanding will be obtained from the detailed description presented hereinbelow, and the accompanying drawings which are given by way of illustration only and are not intended to be limitative to any extent, and wherein.

DETAILED DESCRIPTION

Figure 1:
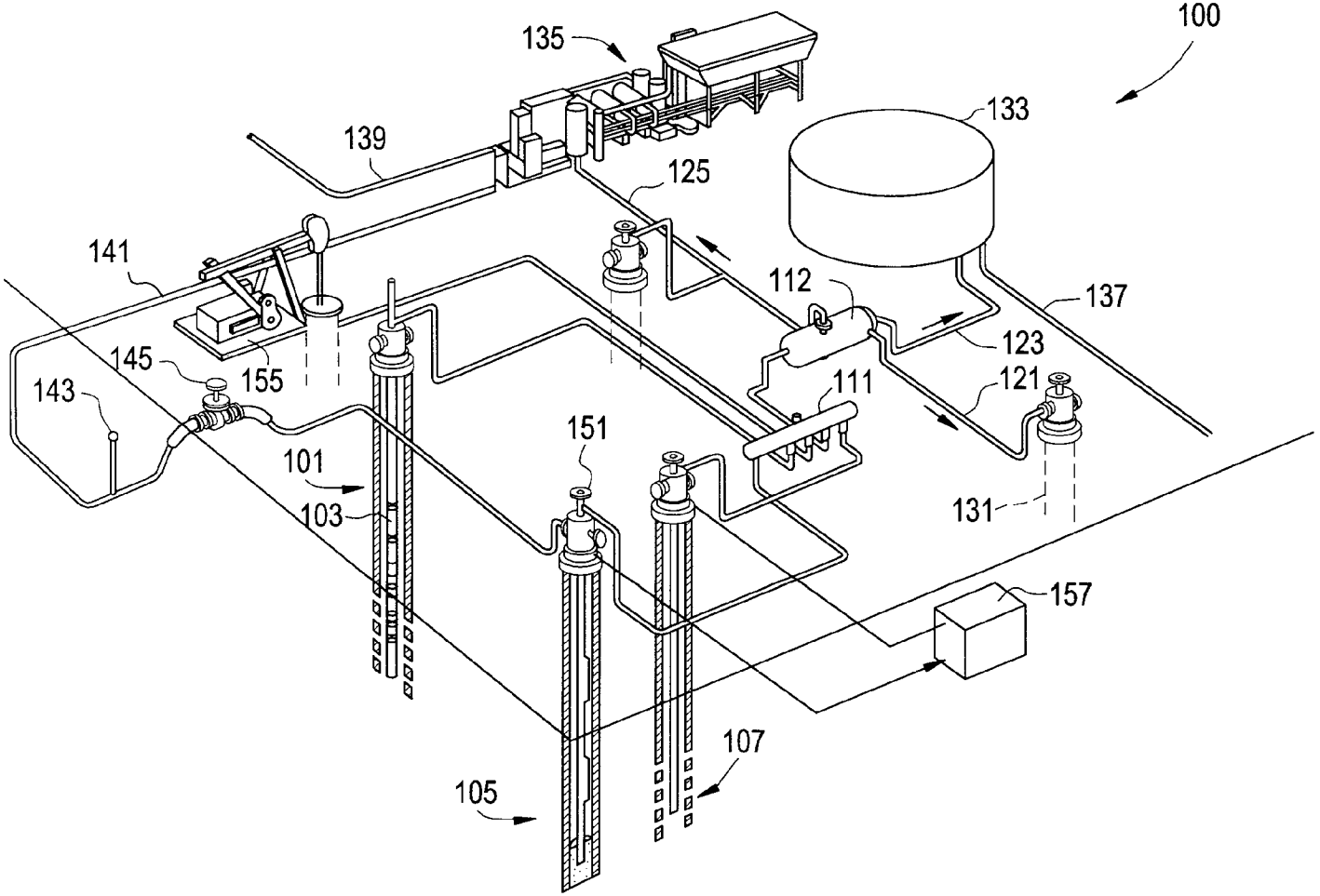
FIG. 1 illustrates a typical oilfield layout.

This specification discloses a method for generating an estimation of an incremental recovery that can be expected from a selected Enhanced Oil Recovery (EOR) Process, which comprises: selecting a set of reservoir properties, selecting an EOR process that is associated with the selected set of reservoir properties, and generating the estimation of the incremental recovery that can be expected from the selected EOR process.

In view of increasing oil prices and declining reserves, the demand for increased recovery and production of oil from oilfield reservoirs has been growing. Enhanced Oil Recovery (EOR) processes for oilfield reservoirs are selected, and, responsive thereto, oil is recovered from the oilfield reservoir at a particular rate. However, the selection of a particular Enhanced Oil Recovery (EOR) process (hereinafter, either an 'EOR Process' or an 'EOR scheme'), associated with a particular level of recovery from the reservoir, is currently being accomplished in a time consuming and disintegrated way. There exists no specific tool that would allow a user to: select 'reservoir properties', select an applicable EOR scheme associated with the 'reservoir properties', and, responsive thereto, generate an 'estimation of the incremental recovery that can be expected from the applicable EOR scheme'. This specification discloses a 'method for generating an estimation of an incremental recovery that can be expected from a selected Enhanced Oil Recovery (EOR) Process'. The aforementioned 'method', including its corresponding system and program storage device and computer program, will guide a user in order to locate and identify technically and economically applicable EOR schemes for oilfield reservoirs in an integrated and efficient manner in order to estimate an incremental recovery that can be expected from a selected Enhanced Oil Recovery (EOR) Process.

The 'method for generating an estimation of an incremental recovery that can be expected from a selected Enhanced Oil Recovery (EOR) Process' disclosed herein is an integrated and smart tool that guides users to identify and select a correct EOR scheme, and, as a result, provides and estimation of recovery gains based on the application of the selected EOR scheme. The 'method for generating an estimation of an incremental recovery that can be expected from a selected Enhanced Oil Recovery (EOR) Process' disclosed herein is practiced by a system that includes 'four parts', namely, an Input, a Screening, an Estimator, and a Smart Guide. The 'four parts' are integrated in such a way that, when a set of reservoir properties (either as a '3D reservoir model' or 'average reservoir properties') are available to the Smart Guide, a subsequent 'reservoir engineering based decision system' allows a user to identify the 'EOR schemes' and, when the 'EOR schemes' are identified, an estimate of an 'Incremental Recovery of oil from a reservoir' is determined.

The Smart Guide System includes a set of 'collective knowledge' that is based on Enhanced Oil Recovery (EOR) knowledge, reservoir engineering knowledge, and reservoir modeling knowledge and expertise.

As a result, in view of the current 'low experience' and resource limited EOR industry, the 'method for generating an estimation of an incremental recovery that can be expected from a selected Enhanced Oil Recovery (EOR) Process' that is disclosed herein will not only impact the quality of EOR projects which could potentially lead to higher recovery performance from the reservoir fields, but will also compensate for a shortage of resources by passing a 'manual engineering decision making process' to the EOR systems in the EOR industry. This will have a positive impact on the optimization of the non-renewable energy resources.

Referring to FIG. 1, a typical oilfield layout is illustrated. In FIG. 1, workers assemble machinery and modify the underlying formations in order to extract hydrocarbons, such as oil and gas. An operations control center 157 may assist in collecting data and making decisions to enhance operations in the oilfield. Data may include, for example, measurements of bottom-hole pressure and tubing head pressure. As shown in FIG. 1, the oil field operations 100 include a number of wells. Specifically, the oil field operations include first producing well 101, which uses an electric submersible pump 103 to produce a hydrocarbon (e.g., oil, gas, etc.), a second well 105, which relies on a gas lift to produce a hydrocarbon; and a third well 107, which produces a hydrocarbon on the basis of natural flow. First producing well 101, second well 105, and third well 107 deliver production fluids (e.g., hydrocarbon produced from their respective wells) to a production manifold 111. The production manifold collects multiple streams and outputs the streams to a gas and oil separator 112. Upon receipt of the production fluids by the gas and oil separator 112, the gas and oil separator 112 separates produced water 121, produced oil 123, and produced gas 125, respectively to water disposal well 131, oil storage 133, and a compressor station 135.

In one embodiment, oil storage 133 may transfer oil via an oil export pipeline 137. Similarly, the compressor station 135 may use gas export pipeline 139 to transfer gas. Finally, the compressor station 135 may process gas as an injection gas 141. In order to adjust pressure on the injection gas, a meter and control system 143 may cooperate with an injection-gas manifold 145. The operation of the meter and control system 143 may regulate pressure of the injection gas as the injection gas is delivered to a wellhead tubing and casing 151. In addition to the injection gas, extracting efforts may rely upon a rod pump 155 to drive a downhole pump assembly via a reciprocating motion. In such cases, the rod pump 155 propels hydrocarbons to the production manifold 111.

The operations control center 157 may receive data from sensors corresponding to the second well 105. The sensors may include, for example, a pressure sensor that measures fluid pressures at the wellhead. The operations control center 157 may also operate and/or control equipment in the third well 107. The operations control center 157 may use a data processing system including a communication unit, a processor, and a memory all of which are connected via a bus. The memory is configured to store one or more sets of instructions. Further, the processor unit (e.g., a microprocessor) is configured to execute one or more of the sets of instructions to control, for example, the operation of the third well 107. In addition, the processor unit may also calculate averages or otherwise combine expert interviewee inputs. Finally, the communication unit operates as an interface between the operations control center 157 and the other oilfield operations components shown in FIG. 1. As such, the communications interface is configured to receive data from the oilfield operations components and to send commands and/or data to the oilfield operations components.

Figure 2:
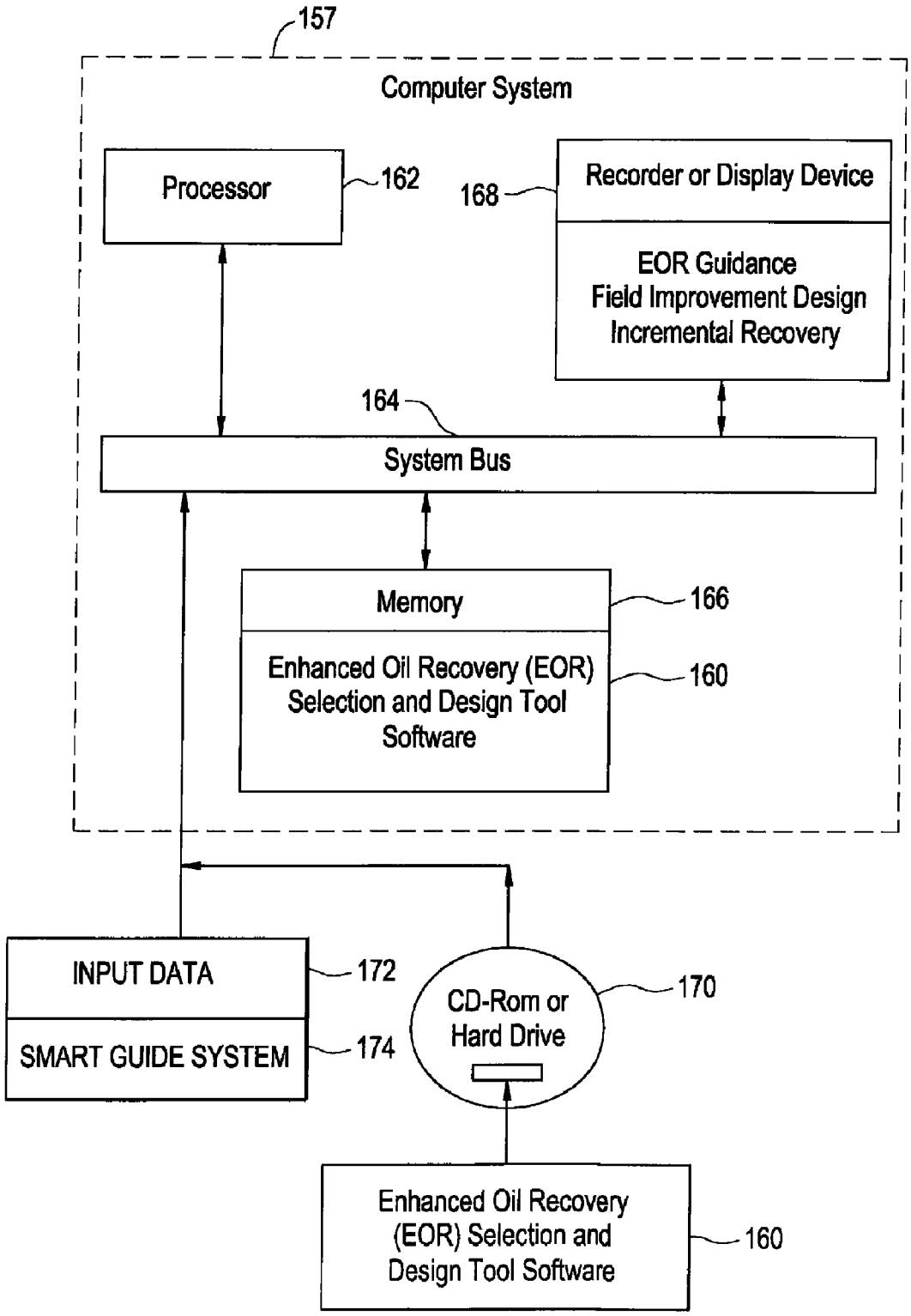
FIG. 2 illustrates a computer system, utilized in the oilfield layout of FIG. 1, which stores an 'Enhanced Oil Recovery (EOR) Selection and Design Tool software' disclosed in this specification.

Referring to FIG. 2, the operations control center 157 of FIG. 1, hereinafter referred to as a 'computer system' 157, is illustrated in greater detail. In FIG. 2, the operations control center 157, or computer system 157, of FIG. 1 is illustrated in greater detail, the computer system 157 of FIG. 2 may be adapted for storing an 'Enhanced Oil Recovery (EOR) Selection and Design Tool software' 160. Recall that the 'Enhanced Oil Recovery (EOR) Selection and Design Tool software' 160 of FIG. 2, when executed by the processor 162 of the computer system 157 of FIG. 2, will practice a method for generating an estimation of an incremental recovery that can be expected from a selected Enhanced Oil Recovery (EOR) Process, the method comprising: selecting a set of reservoir properties, selecting an EOR process that is associated with the selected set of reservoir properties, and generating the estimation of the incremental recovery that can be expected from the selected EOR process.

The computer system 157 of FIG. 2 includes a Processor 162 operatively connected to a system bus 164, a memory or other program storage device 166 operatively connected to the system bus 164, and a recorder or display device 168 operatively connected to the system bus 164. The memory or other program storage device 166 stores the 'Enhanced Oil Recovery (EOR) Selection and Design Tool software' 160 that practices the 'method for generating an estimation of an incremental recovery that can be expected from a selected Enhanced Oil Recovery (EOR) Process' previously discussed and disclosed in this specification. The Processor 162 of FIG. 2 responds to a set of Input Data 172, where the Input Data 172 includes a Smart Guide System 174. The Smart Guide System 174 will be discussed in greater detail below with reference to FIGS. 3 and 4 of the drawings. The Input Data 172 of FIG. 2 also includes a 'set of reservoir properties', such as either as a '3D reservoir model' or 'average reservoir properties' which are supplied by the 'Input' 176 of FIGS. 3 and 5.

The 'Enhanced Oil Recovery (EOR) Selection and Design Tool software' 160, which is stored in the memory 166 of FIG. 2, can be initially stored on a Hard Disk or CD-Rom 170, where the Hard Disk or CD-Rom 170 is also a 'program storage device'. The CD-Rom 170 can be inserted into the computer system 157, and the 'Enhanced Oil Recovery (EOR) Selection and Design Tool software' 160 can be loaded from the CD-Rom 170 and into the memory/program storage device 166 of the computer system 157 of FIG. 2. The Processor 162 will execute the 'Enhanced Oil Recovery (EOR) Selection and Design Tool software' 160 that is stored in memory 166 of FIG. 2; and, responsive thereto, the Processor 162 will generate an 'output display' that is recorded or displayed on a Recorder or Display device 168 of FIG. 2. The 'output display' of the 'recorder or display device' 168 is adapted for recording or displaying: (1) Enhanced Oil Recovery (EOR) Guidance, (2) a Reservoir Field Improvement Design, and/or (3) an Incremental Recovery that can be expected from a selected EOR process. The computer system 157 of FIG. 2 may be a personal computer (PC), a workstation, a microprocessor, or a mainframe. Examples of possible workstations include a Silicon Graphics Indigo 2 workstation or a Sun SPARC workstation or a Sun ULTRA workstation or a Sun BLADE workstation. The memory or program storage device 166 (including the above referenced Hard Disk or CD-Rom 170) is a 'computer readable medium' or a 'program storage device' which is readable by a machine, such as the processor 162. The processor 162 may be, for example, a microprocessor, microcontroller, or a mainframe or workstation processor. The memory or program storage device 166, which stores the 'Enhanced Oil Recovery (EOR) Selection and Design Tool software' 160, may be, for example, a hard disk, ROM, CD-ROM, DRAM, or other RAM, flash memory, magnetic storage, optical storage, registers, or other volatile and/or non-volatile memory.

Figure 3:
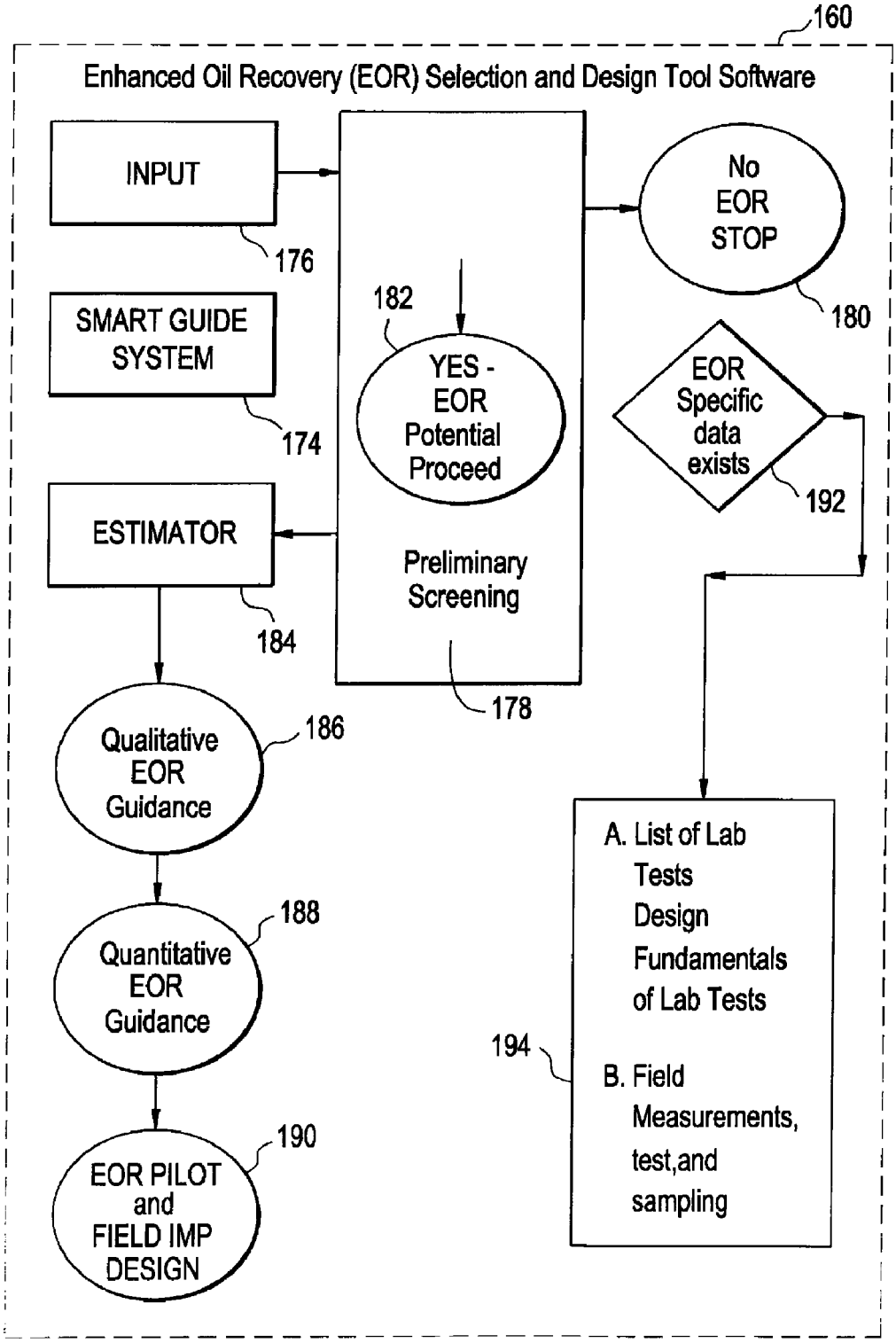
FIG. 3 illustrates a first construction of the 'Enhanced Oil Recovery (EOR) Selection and Design Tool software' that is stored in the memory of the computer system of FIG. 2.

Referring to FIG. 3, a first construction of the 'Enhanced Oil Recovery (EOR) Selection and Design Tool software' 160 that is stored in memory 166 of FIG. 2 is illustrated. In FIG. 3, an Input step 176 includes and generates a 'set of reservoir properties', such as either a '3D reservoir model' or 'average reservoir properties'. The 'set of reservoir properties', generated from the Input step 176, are received by a Preliminary Screening step 178. In the Preliminary Screening step 178, in response to the set of reservoir properties' received from the Input 176, the Processor 162 of the computer system 157 of FIG. 2 will consult the Smart Guide System 174 of FIG. 3 in an attempt to match the received 'set of reservoir properties' with all of the information stored in the Smart Guide System 174 in FIG. 3.

In response thereto, the Processor 162 will determine that either: (1) 'EOR Potential exists', or (2) 'No EOR potential exists' for the aforementioned 'set of reservoir properties'. If 'No EOR potential exists', go to the 'No EOR Stop' step 180, and the Processor 162 stops executing the software 160 of FIG. 2. However, if 'EOR Potential exists', go to the 'YES—EOR Potential Proceed' step 182 in FIG. 3. At this point, the Processor 162 encounters a 'YES—EOR Potential Proceed' step 182. When the Processor 162 encounters the 'YES—EOR Potential Proceed' step 182, certain 'EOR specific data exists', step 192. The 'EOR specific data' could include the data illustrated in step 194: (1) a list of lab tests, and/or design fundamentals of the lab tests, and/or (2) field measurements and/or field tests and sampling. When the Processor 162 of FIG. 2 encounters the 'YES—EOR Potential Proceed' step 182, an Estimator 184 will then generate an 'Incremental Recovery that can be expected from a selected EOR process' which can be recorded or displayed on the 'output display' of the 'recorder or display device' 168 of FIG. 2. When the Estimator 184 generates the 'Incremental Recovery that can be expected from a selected EOR process', the Estimator 184 will also generate: (1) Qualitative EOR Guidance 186, (2) Quantitative EOR Guidance 188, and (3) an EOR pilot and field improvement design 190 (each of which can also be displayed on the 'output display' of the recorder or display device 168) that is adapted for generating an increased or an additional/incremental amount of oil from an oilfield reservoir.

Figure 4:
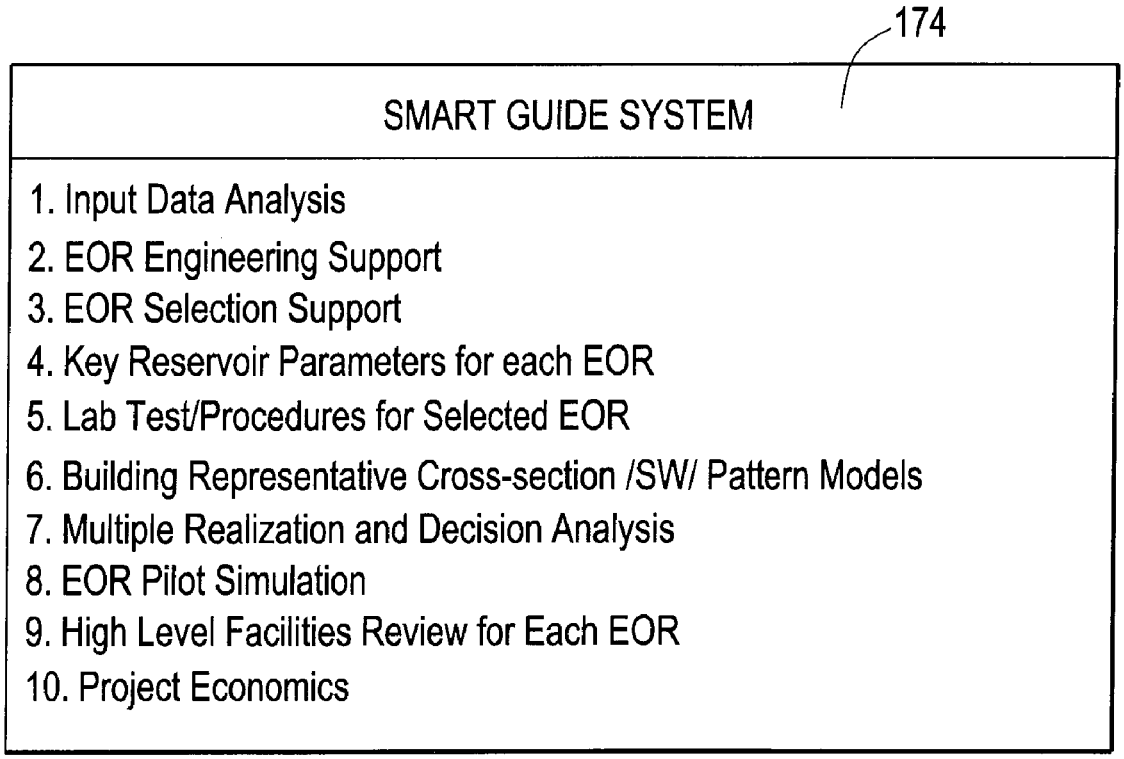
FIG. 4 illustrates a more detailed description of the Smart Guide System illustrated in FIGS. 2 and 3.

Referring to FIG. 4, a more detailed description of the Smart Guide System 174 of FIGS. 2 and 3 is illustrated. In FIG. 4, recall that the Processor 162 of the computer system 157 of FIG. 2 will consult the Smart Guide System 174 of FIG. 3 in an attempt to match the 'set of reservoir properties' received from the Input 176 with all of the 'information stored in the Smart Guide System 174' in FIG. 3. In response thereto, the Processor 162 will determine that either: (1) 'EOR Potential exists', or (2) 'No EOR potential exists' for the aforementioned 'set of reservoir properties'. In FIG. 4, the 'information stored in the Smart Guide System 174' includes the following information: (1) Input data analysis, (2) EOR engineering support, (3) EOR selection support, (4) key reservoir parameters for each EOR, (5) lab test/procedures for selected EOR, (6) representative cross section/SW/pattern models, (7) multiple realization and decision analysis, (8) EOR pilot simulation, (9) high level facilities review for each EOR, and (10) project economics. As a result, the Processor 162 of the computer system 157 of FIG. 2 will consult the Smart Guide System 174 of FIG. 3 (and, in particular, the ten items illustrated in FIG. 4) in an attempt to match the 'set of reservoir properties' received from the Input 176 with all of the 'information stored in the Smart Guide System 174' in order to determine if: (1) 'EOR Potential exists', or (2) 'No EOR potential exists' for the aforementioned 'set of reservoir properties'.

Figure 5:
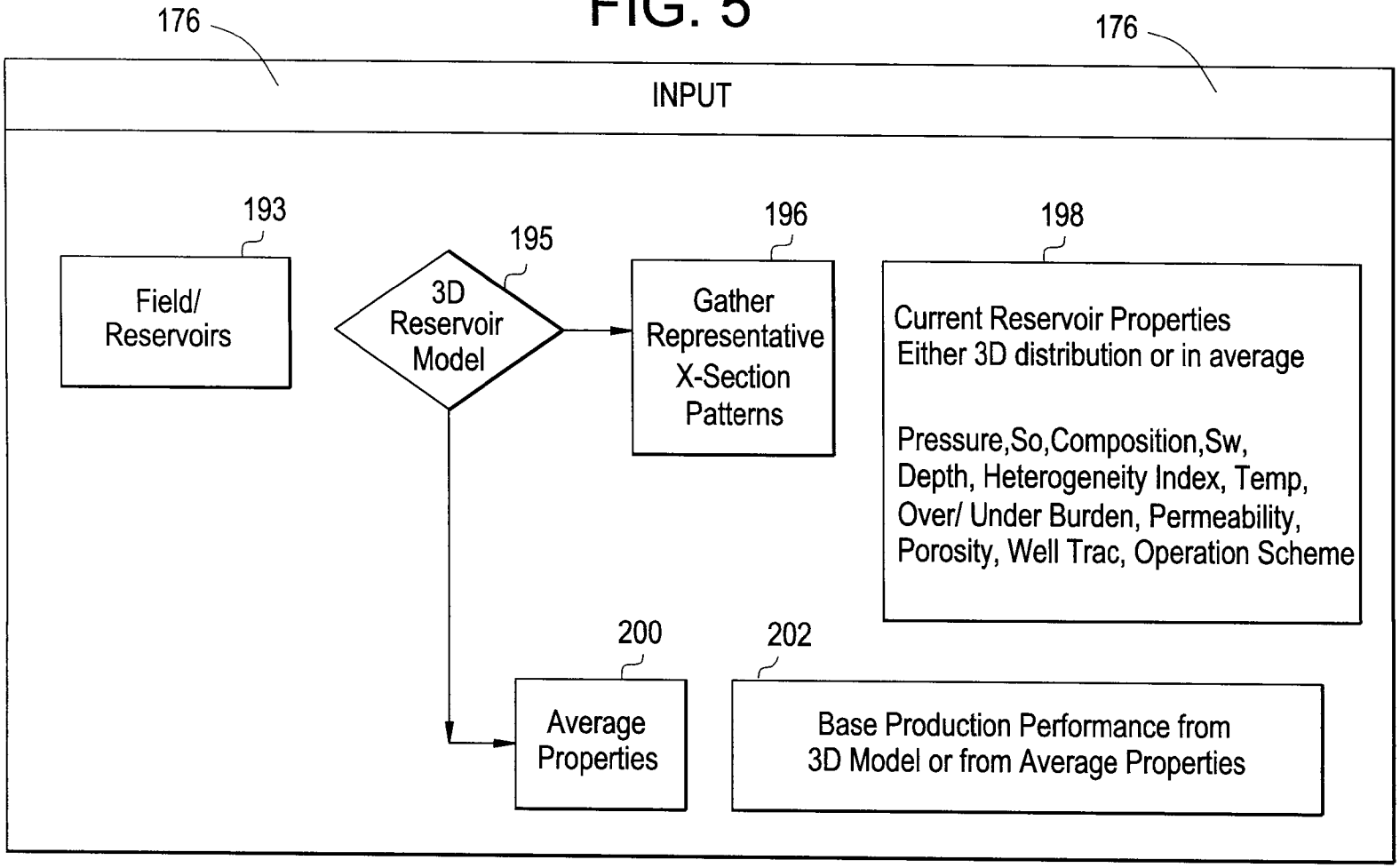
FIG. 5 illustrates a more detailed construction of the Input step which is illustrated as part of the first construction of the 'Enhanced Oil Recovery (EOR) Selection and Design Tool software' of FIG. 3.

Referring to FIG. 5, a detailed construction of the Input 176 of FIG. 3 is illustrated. In FIG. 5, recall that the Input step 176 of FIG. 3 generates a 'set of reservoir properties', such as either a '3D reservoir model' or 'average reservoir properties' that are input to the Preliminary Screening step 178. In FIG. 5, a reservoir field 193 is modeled or simulated, in a reservoir simulator, thereby generating a 3D reservoir model 195. In connection with the 3D reservoir model 195, refer to the 'gather representative cross-section patterns' step 196. In connection with the 'representative cross-section patterns' of step 196, refer to block 198 wherein the 'representative cross-section patterns' of step 196 will provide 'current reservoir properties' which are characterized by 'either a 3D distribution or in average', including, but not limited to, the following: pressure, So, composition, Sw, depth, heterogeneity Index, Temperature, over/under burden, permeability, porosity, well trac, and operation scheme. In addition, in connection with the 3D reservoir model 195, refer to the 'average properties' step 200. In connection with the 'average properties' step 200, refer to block 202 wherein the 'average properties' will be generated in response to a 'base production performance from the 3D model 195' or from 'average properties'. Therefore, the Input 176 of FIG. 5 will generate a 'set of reservoir properties', such as either a '3D reservoir model' or 'average reservoir properties' that are input to the Preliminary Screening step 178.

Figure 6:
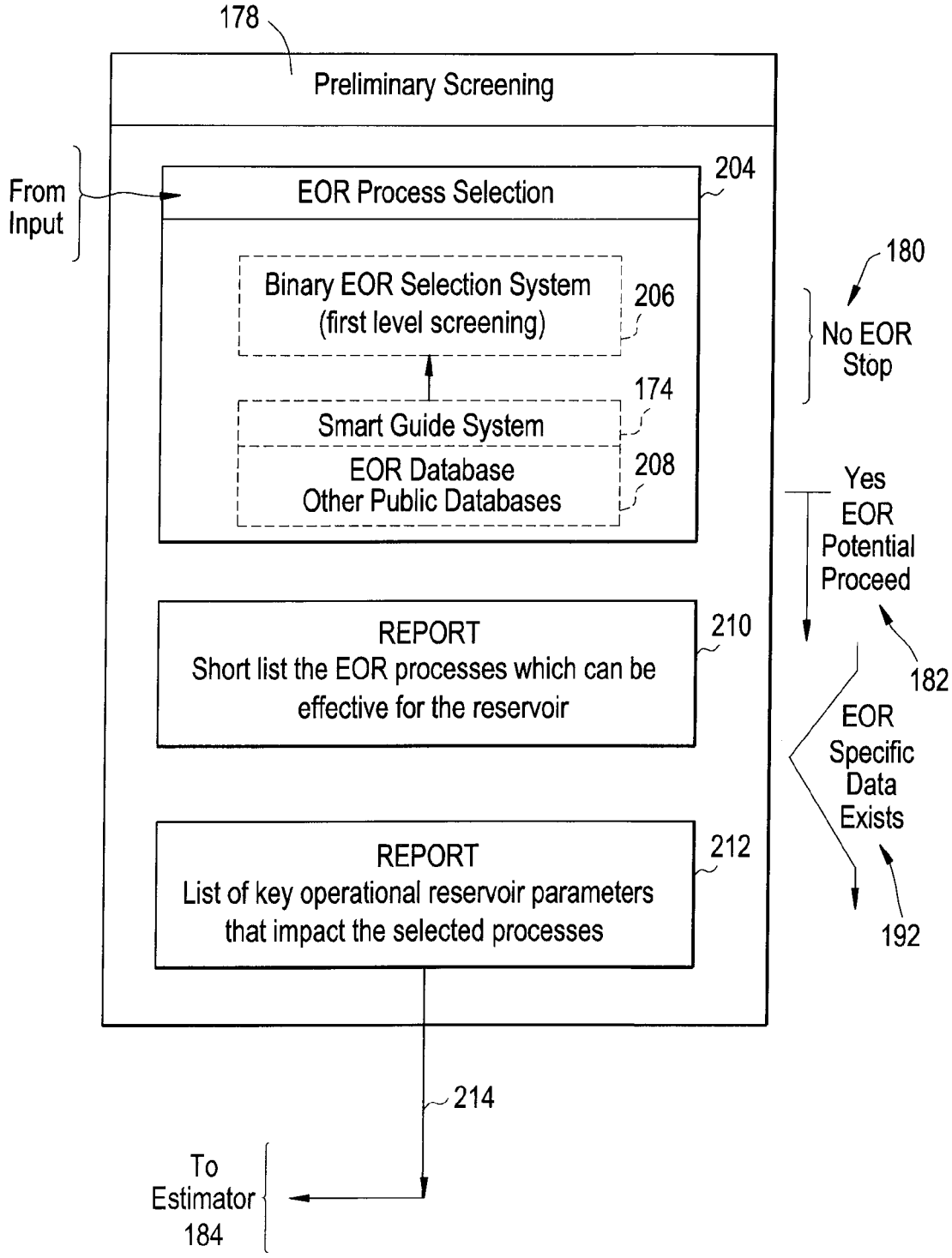
FIG. 6 illustrates a more detailed construction of the Preliminary Screening step which is illustrated as part of the first construction of the 'Enhanced Oil Recovery (EOR) Selection and Design Tool software' of FIG. 3.

Referring to FIG. 6, a detailed construction of the Preliminary Screening step 178 of FIG. 3 is illustrated. In FIG. 6, recall from FIG. 3 that, in the Preliminary Screening step 178, in response to the 'set of reservoir properties' received from the Input 176, the Processor 162 of the computer system 157 of FIG. 2 will consult the Smart Guide System 174 in an attempt to match the received 'set of reservoir properties' with all of the information stored in the Smart Guide System 174 in FIG. 6. In response thereto, the Processor 162 will determine that either: (1) 'EOR Potential exists', or (2) 'No EOR potential exists' for the aforementioned 'set of reservoir properties'. If 'No EOR potential exists', go to the 'No EOR Stop' step 180, and the Processor 162 stops executing the software 160 of FIG. 2. However, if 'EOR Potential exists', go to the 'YES—EOR Potential Proceed' step 182 in FIG. 6. At this point, the Processor 162 encounters a 'YES—EOR Potential Proceed' step 182. When the Processor 162 encounters the 'YES—EOR Potential Proceed' step 182, certain 'EOR specific data exists', step 192. The 'EOR specific data' could include the data illustrated in step 194 of FIG. 3: (1) a list of lab tests, and/or design fundamentals of the lab tests, and/or (2) field measurements and/or field tests and sampling. In FIG. 6, in response to the 'set of reservoir properties', such as either a '3D reservoir model' or 'average reservoir properties', from the Input 176, in an EOR Process Selection step 204, a Binary EOR Selection System 206 will receive the 'set of reservoir properties' from the Input 176 and, responsive thereto, the EOR Selection System 206 will consult the Smart Guide System 174 to determine if EOR Potential exists in connection with the received 'set of reservoir properties'.

Recall, in FIG. 4, that the Smart Guide System 174 contains a multitude of information that is used, by the EOR Selection System 206, to determine if EOR Potential exists in connection with the received 'set of reservoir properties'. If, after consulting the Smart Guide System 174, the EOR Selection System 206 determines that EOR potential does, in fact, exist in connection with the 'set of reservoir properties' received from the Input 176, the EOR Selection System 206 will now consult an 'EOR Database or other public databases' 208 in FIG. 6. The 'EOR Database or other public databases' 208 stores a 'plurality of reservoir properties' and a 'plurality of EOR processes' (or a 'plurality of EOR schemes') which correspond, respectively, with the 'plurality of reservoir properties'.

The EOR Selection System 206 will now attempt to match, or substantially match, the 'set of reservoir properties' which are received from the Input 176 with a one of the 'plurality of reservoir properties' stored in the 'EOR Database or other public databases' 208. Recalling that the 'EOR Database or other public databases' 208 stores 'one of the plurality of reservoir properties' and an 'EOR process' or an 'EOR Scheme' that corresponds to the 'one of the plurality of reservoir properties', when the EOR Selection System 206 locates a match, or a substantial match, between the 'set of reservoir properties' which are received from the Input 176 with the 'one of the plurality of reservoir properties' stored in the 'EOR Database or other public databases' 208, the EOR Selection System 206 will now generate the 'EOR process' or 'EOR Scheme' that corresponds to the 'one of the plurality of reservoir properties'. In the Preliminary Screening step 178 of FIG. 6, a report 210 is generated which will provide a short list of the 'EOR processes' which can be effective for the reservoir field 192 of FIG. 5. In addition, in the Preliminary Screening step 178 of FIG. 6, another report 212 is generated which will provide a list of key operational reservoir parameters that impact the selected 'EOR processes'. In FIG. 6, recalling that the EOR Selection System 206 generates, via arrow 214 in FIG. 6, the 'EOR process' or 'EOR Scheme' that corresponds to the 'one of the plurality of reservoir properties', the 'EOR process' or 'EOR Scheme' is now transmitted, via arrow 214, to the Estimator 184 of FIGS. 3 and 7.

Figure 7:
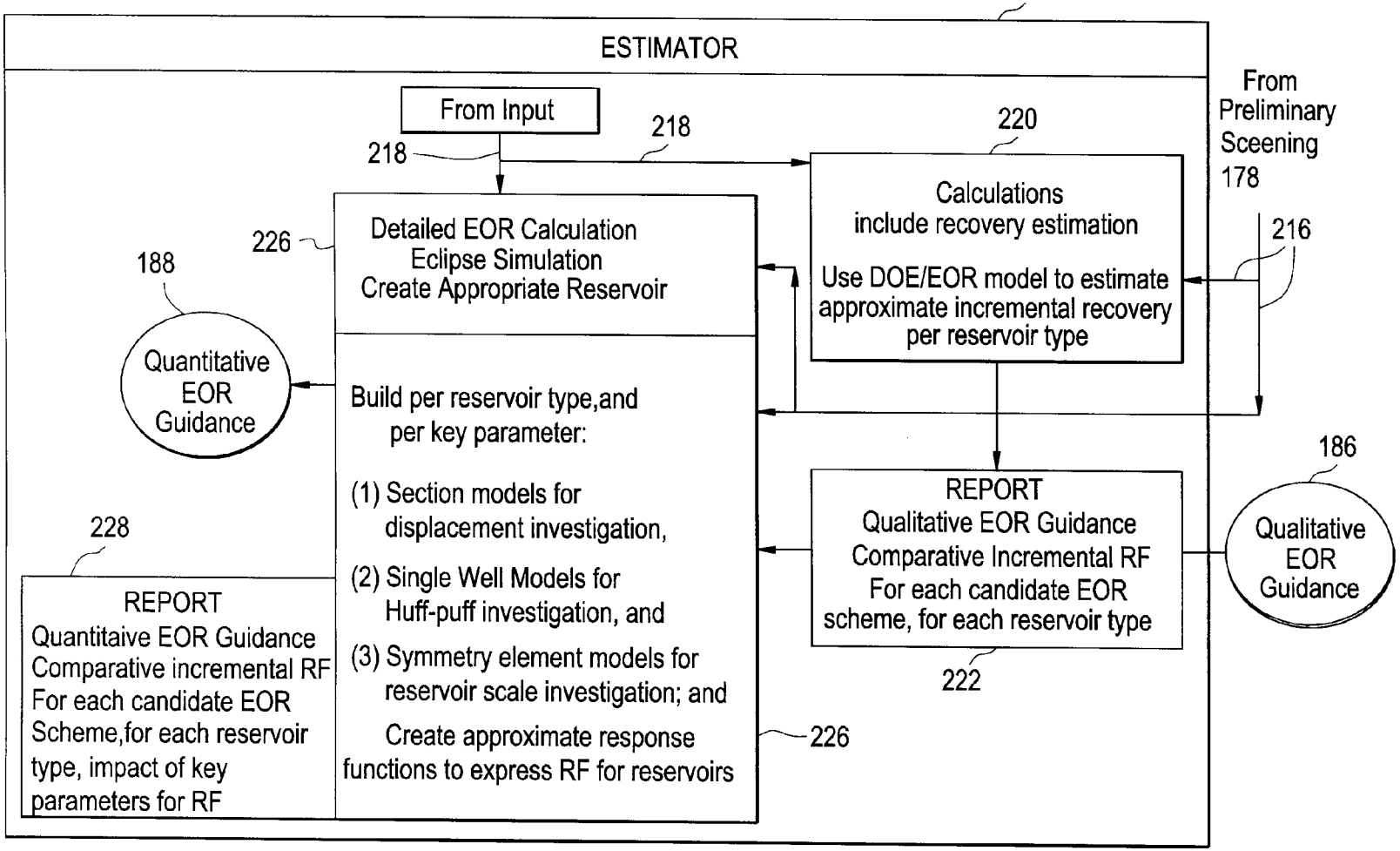
FIG. 7 illustrates a more detailed construction of the Estimator step which is illustrated as part of the first construction of the 'Enhanced Oil Recovery (EOR) Selection and Design Tool software' of FIG. 3.

Referring to FIG. 7, a detailed construction of the Estimator 184 of FIG. 3 is illustrated. In FIG. 7, the 'EOR process' or 'EOR Scheme' from the Preliminary Screening step 178 is received by the Estimator 184 via arrow 216 in FIG. 7. In addition, the 'set of reservoir properties' from the Input 176 are received by the Estimator 184 via arrow 218 in FIG. 7. In the Estimator 184 of FIG. 7, a 'first set of calculations' 220 are performed via step 220 in FIG. 7, the 'first set of calculations' 220 receiving: (1) the 'EOR process' from the Preliminary Screening step 178 via arrow 216, and (2) the 'set of reservoir properties' from the Input 176 via arrow 218 in FIG. 7.

In FIG. 7, the 'first set of calculations' 220 will utilize the 'EOR process' (from the Preliminary Screening step 178) and the 'set of reservoir properties' (from the Input 176) to calculate a 'recovery estimation' that will 'estimate approximate incremental recovery per reservoir type', step 220 in FIG. 7. In FIG. 7, in response to the completion of the performance of the 'first set of calculations' 220, a Report 222 is generated that will provide: (1) Qualitative EOR Guidance, and (2) a comparative incremental recovery factor (RF) for each candidate 'EOR Scheme' (or 'EOR process' for each reservoir type. In view of the generation of the Report 222, 'Qualitative EOR Guidance' 186 is provided and generated for a user. In the Estimator 184 of FIG. 7, a 'second set of calculations' 226 are performed via step 226 in FIG. 7, the 'second set of calculations' 226 receiving: (1) the 'EOR process' from the Preliminary Screening step 178 via arrow 216, and (2) the 'set of reservoir properties' from the Input 176 via arrow 218 in FIG. 7.

In FIG. 7, the 'second set of calculations' 226 will utilize the 'EOR process' (from the Preliminary Screening step 178) and the 'set of reservoir properties' (from the Input 176) to generate a 'Detailed EOR Calculation' in connection with an 'Eclipse simulation' in order to 'create an appropriate reservoir'. In FIG. 7, step 226, in order to 'create an appropriate reservoir', it is necessary to 'build per reservoir type, and per key parameter': (1) Section models for displacement investigation, (2) Single well models for Huff-Puff investigation, and (3) Symmetry element models for a reservoir scale investigation; and to 'create approximate response' functions to express an incremental recovery factor (RF) for the reservoirs. In FIG. 7, in response to the completion of the performance of the 'second set of calculations' 226, a Report 228 is generated that will provide: (1) Quantitative EOR Guidance, and (2) a comparative incremental recovery factor (RF) for each candidate 'EOR Scheme' and for each reservoir type, and (3) the impact of key parameters for each RF; that is, a list of the key operational reservoir parameters that impact the selected 'EOR processes'. In view of the generation of the Report 228, 'Quantitative EOR Guidance' 188 is provided and generated for a user.

Figure 8:
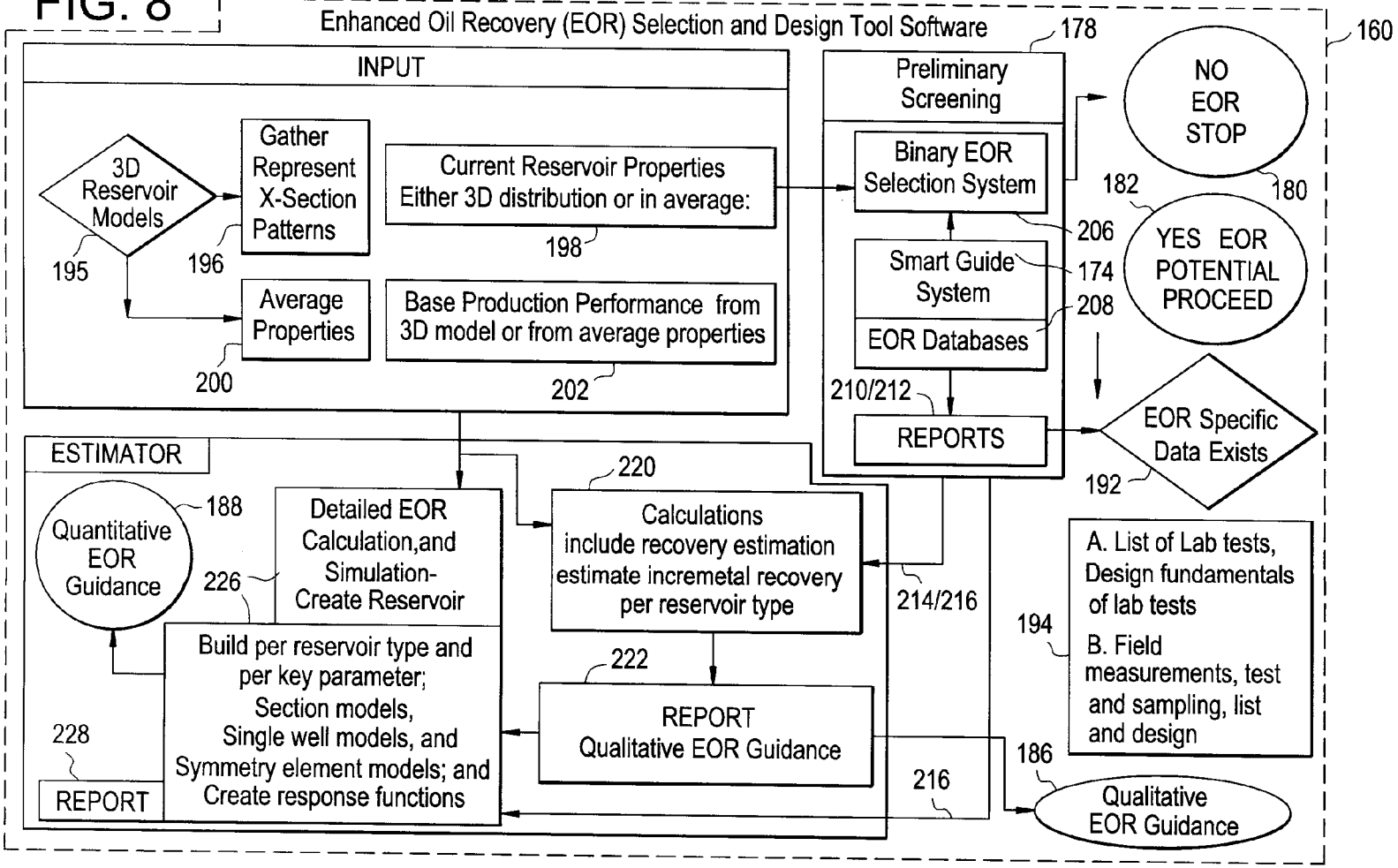
FIG. 8 illustrates a second, more detailed construction of the 'Enhanced Oil Recovery (EOR) Selection and Design Tool software' that is stored in the memory of the computer system of FIG. 2.

Refer now to FIG. 8. A functional description of the operation of the 'Enhanced Oil Recovery (EOR) Selection and Design Tool software' 160 of FIG. 2, when executed by the Processor 162 of FIG. 2, is set forth in the following paragraph with reference to FIG. 8 of the drawings.

Recall that this specification discloses a 'method for generating an estimation of an incremental recovery that can be expected from a selected Enhanced Oil Recovery (EOR) Process', which comprises: selecting a set of reservoir properties, selecting an EOR process that is associated with the selected set of reservoir properties, and generating the estimation of the incremental recovery that can be expected from the selected EOR process.

In FIG. 2, when the processor 162 executes the Enhanced Oil Recovery (EOR) Selection and Design Tool software 160, in response to the input data 172 including the smart guide system 174 and the representative cross sections 196 and average properties 200 of FIG. 5, the processor 162 will generate 'EOR Guidance' and a 'field improvement design' and information pertaining to an 'incremental recovery', all of which can be recorded or displayed on the 'recorder or display device' 168 of FIG. 2.

In FIG. 8, the Input 176 will receive a 3D reservoir model 195 and, responsive thereto, the Input 176 will generate 'representative cross section patterns' 196 and 'average properties' 200 which is hereinafter referred to as a 'set of reservoir properties'.

In FIG. 8, in the Preliminary Screening step 178, in response to the 'set of reservoir properties' received from the Input 176 (such as either a '3D reservoir model' or 'average reservoir properties'), a Binary EOR Selection System 206 will receive the 'set of reservoir properties' from the Input 176 and, responsive thereto, the EOR Selection System 206 will consult the Smart Guide System 174 to determine if EOR Potential exists in connection with the received 'set of reservoir properties'. Recall, in FIG. 4, that the Smart Guide System 174 contains a multitude of information that is used, by the EOR Selection System 206, to determine if EOR Potential exists in connection with the received 'set of reservoir properties'. If, after consulting the Smart Guide System 174, the EOR Selection System 206 determines that EOR potential does, in fact, exist in connection with the 'set of reservoir properties' received from the Input 176, the EOR Selection System 206 will now consult an 'EOR Database or other public databases' 208 in FIG. 8.

The 'EOR Database or other public databases' 208 stores a 'plurality of reservoir properties' and a 'plurality of EOR processes' (or a 'plurality of EOR schemes') which correspond, respectively, with the 'plurality of reservoir properties'. The EOR Selection System 206 will now attempt to match, or substantially match, the 'set of reservoir properties' which are received from the Input 176 with a one of the 'plurality of reservoir properties' stored in the 'EOR Database or other public databases' 208. Recalling that the 'EOR Database or other public databases' 208 stores 'one of the plurality of reservoir properties' and an 'EOR process' or an 'EOR Scheme' that corresponds to the 'one of the plurality of reservoir properties', when the EOR Selection System 206 locates a match, or a substantial match, between the 'set of reservoir properties' which are received from the Input 176 with the 'one of the plurality of reservoir properties' stored in the 'EOR Database or other public databases' 208, the EOR Selection System 206 will now generate the 'EOR process' or 'EOR Scheme' that corresponds to the 'one of the plurality of reservoir properties'.

In the Preliminary Screening step 178 of FIG. 6, a report 210 is generated which will provide a short list of the 'EOR processes' which can be effective for the reservoir field 192 of FIG. 5. In addition, in the Preliminary Screening step 178 of FIG. 8, another report 212 is generated which will provide a list of key operational reservoir parameters that impact the selected 'EOR processes'. In FIG. 8, recalling that the EOR Selection System 206 generates, via arrow 214 in FIG. 8, the 'EOR process' or 'EOR Scheme' that corresponds to the one of the plurality of reservoir properties, the 'EOR process' or EOR Scheme is now transmitted, via arrow 214, to the Estimator 184 of FIG. 8.

In FIG. 8, the 'EOR process' or 'EOR Scheme' from the Preliminary Screening step 178 is received by the Estimator 184. In addition, the 'set of reservoir properties' from the Input 176 are received by the Estimator 184. In the Estimator 184 of FIG. 8, a 'first set of calculations' 220 are performed, the 'first set of calculations' 220 receiving: (1) the 'EOR process' from the Preliminary Screening step 178, and (2) the 'set of reservoir properties' from the Input 176. In FIG. 8, the 'first set of calculations' 220 will utilize the 'EOR process' (from the Preliminary Screening step 178) and the 'set of reservoir properties' (from the Input 176) to calculate a 'recovery estimation' that will 'estimate approximate incremental recovery per reservoir type', step 220 in FIG. 8. In FIG. 8, in response to the completion of the performance of the 'first set of calculations' 220, a Report 222 is generated that will provide: (1) Qualitative EOR Guidance, and (2) a comparative incremental recovery factor (RF) for each candidate 'EOR Scheme' (or 'EOR process' for each reservoir type. In view of the generation of the Report 222, 'Qualitative EOR Guidance' 186 is provided and generated for a user.

In the Estimator 184 of FIG. 8, a 'second set of calculations' 226 are performed via step 226 in FIG. 8, the 'second set of calculations' 226 receiving: (1) the 'EOR process' from the Preliminary Screening step 178, and (2) the 'set of reservoir properties' from the Input 176. In FIG. 8, the 'second set of calculations' 226 will utilize the 'EOR process' (from the Preliminary Screening step 178) and the 'set of reservoir properties' (from the Input 176) to generate a 'Detailed EOR Calculation' in connection with an 'Eclipse simulation' in order to 'create an appropriate reservoir'. In FIG. 8, in step 226, in order to 'create an appropriate reservoir', it is necessary to 'build per reservoir type, and per key parameter': (1) Section models for displacement investigation, (2) Single well models for Huff-Puff investigation, and (3) Symmetry element models for a reservoir scale investigation; and to 'create approximate response' functions to express an incremental recovery factor (RF) for the reservoirs.

In FIG. 8, in response to the completion of the performance of the 'second set of calculations' 226, a Report 228 is generated that will provide: (1) Quantitative EOR Guidance, and (2) a comparative incremental recovery factor (RF) for each candidate 'EOR Scheme' and for each reservoir type, and (3) the impact of key parameters for each RF; that is, a list of the key operational reservoir parameters that impact the selected 'EOR processes'. In view of the generation of the Report 228, 'Quantitative EOR Guidance' 188 is provided and generated for a user.

The above description of the 'Method for generating an estimation of an incremental recovery that can be expected from a selected Enhanced Oil Recovery (EOR) Process' being thus described, it will be obvious that the same may be varied in many ways. Such variations are not to be regarded as a departure from the spirit and scope of the claimed method or system or program storage device or computer program, and all such modifications as would be obvious to one skilled in the art are intended to be included within the scope of the following claims.

I claim:

1. A program storage device readable by a machine, tangibly embodying a set of instructions executable by the machine, to perform method steps for generating an estimation of an incremental recovery that can be expected from an Enhanced Oil Recovery (EOR) Process, the method steps comprising:

selecting a set of reservoir properties; selecting an EOR process that is associated with the selected set of reservoir properties by consulting a Smart Guide System to determine if an EOR potential exists in connection with said set of reservoir properties and, when the EOR potential exists in connection with said set, of reservoir properties, consulting one or more EOR databases and selecting the EOR process which corresponds to said set of reservoir properties; and generating the estimation of the incremental recovery that can be expected from the selected EOR process.

2. The program storage device of claim 1, wherein the generating step for generating the estimation of the incremental recovery that can be expected from the selected EOR process comprises: calculating an incremental recovery per reservoir type in response to the EOR process and in response to the set of reservoir properties, the incremental recovery representing the estimation of the incremental recovery that can be expected from the selected EOR process.

3. The program storage device of claim 2, further comprising: generating qualitative EOR guidance in response to the estimate of the incremental recovery that can be expected from the selected EOR process; and generating quantitative EOR guidance in response to the estimate of the incremental recovery that can be expected from the selected EOR process.

4. The program storage device of claim 3, further comprising: generating a reservoir field improvement design in response to the qualitative EOR guidance and the quantitative EOR guidance.

5. A computer program stored in a processor readable medium and adapted to be executed by the processor, the computer program, when executed by the processor, conducting a process for generating an estimation of an incremental recovery that can be expected from an Enhanced Oil Recovery (FOR) Process, the process comprising:

selecting a set of reservoir properties; selecting an FOR process that is associated with the selected set of reservoir properties by consulting a Smart Guide System to determine if EOR potential exists in connection with said set of reservoir properties and, when the EOR potential exists in connection with said set of reservoir properties, consulting one or more EOR databases and selecting an EOR process which corresponds to said set of reservoir properties; and generating the estimation of the incremental recovery that can be expected from the selected EOR process.

6. The computer program of claim 5, wherein the generating step for generating the estimation of the incremental recovery that can he expected from the selected EOR process comprises: calculating an incremental recovery per reservoir type in response to the EOR process and in response to the set of reservoir properties, the incremental recovery representing the estimation of the incremental recover that can be expected from the selected EOR process.

7. The computer program of claim 6, further comprising: generating qualitative EOR guidance in response to the estimate of the incremental recovery that can be expected from the selected EOR process; and generating quantitative EOR guidance in response to the estimate of the incremental recovery that can be expected from the selected EOR process.

8. The computer program of claim 7, further comprising: generating a reservoir field improvement design in response to the qualitative EOR guidance and the quantitative EOR guidance.

* * * * *